US005307779A

United States Patent [19]

Wood et al.

[11] Patent Number: 5,307,779

[45] Date of Patent: May 3, 1994

[54] APPARATUS FOR TREATING AND CONDITIONING FUEL FOR USE IN AN INTERNAL COMBUSTION ENGINE

[76] Inventors: Don W. Wood, #26 - 1450 Johnston Road, White Rock, British Columbia, Canada, V4B 5E9; Mark H. Woodruffe, Noke Farm Cottage, Hoggs Cross Lane, Chipstead, Surrey, England

[21] Appl. No.: 6,784

[22] Filed: Jan. 14, 1993

[51] Int. Cl.[5] ..... F02M 27/00

[52] U.S. Cl. ..... 123/538; 431/2

[58] Field of Search ..... 123/536, 537, 538, 539; 431/2

[56] References Cited

U.S. PATENT DOCUMENTS

| | | | |
|---|---|---|---|
| 4,429,665 | 2/1984 | Brown | 123/538 |
| 4,538,582 | 9/1985 | Wakuta | 123/538 |
| 4,715,325 | 12/1987 | Walker | 123/538 |
| 4,930,483 | 6/1990 | Jones | 123/538 |
| 5,044,347 | 9/1991 | Ullrich et al. | 123/538 |
| 5,048,499 | 9/1991 | Daywalt | 123/538 |
| 5,059,217 | 10/1991 | Arroyo et al. | 123/538 |
| 5,197,446 | 3/1993 | Daywalt et al. | 123/538 |

*Primary Examiner*—Tony M. Argenbright
*Assistant Examiner*—M. Macy
*Attorney, Agent, or Firm*—Hughes & Multer

[57] ABSTRACT

A device for conditioning a liquid fuel flowing therethrough. There is a casing with fuel inlet and outlet ports, and at least one insert within the casing which defines passages through which the fuel must pass in streams. The insert contains one or more trace metal elements which are added to the fuel as the fuel flows over the surface of the insert. The insert may be made of an amalgam, and the trace elements may include tin, mercury, lead, and antimony, which may be desirable to add to the liquid fuel. The insert may be formed with a longitudinally extending hub portion from which fins portions extend radially, and the casing may be tubular so that the fuel streams are constrained to the passages formed between the fins. There may also be a magnet mounted in the casing for conditioning the fuel passing therethrough.

24 Claims, 2 Drawing Sheets

APPARATUS FOR TREATING AND CONDITIONING FUEL FOR USE IN AN INTERNAL COMBUSTION ENGINE

BACKGROUND OF THE INVENTION

1. Field of the Invention

The present invention relates generally to fuel systems, and more particularly to apparatus for treating and conditioning fuel for use in an internal combustion engine.

2. Background Art

It has been recognized for many years that the addition of small amounts of certain metallic elements, such as tin, can improve the combustion characteristics of liquid fuels such as petrol and diesel oil. It is also well known that there are increasingly strict regulations with regard to exhaust emissions from internal combustion engines due to the harmful effects of certain exhaust gases on the environment. The improvement in the combustion characteristics which is effected by the addition of trace amounts of metals to the fuel can therefore help with emission control by reducing the pollution effects of exhaust gases by reducing the amount of unburnt fuel exhausted, as well as by improving engine efficiency by increasing the amount or percentage of the fuel actually burnt in the engine.

Furthermore, it has been prior practice to add relatively large amounts of certain metals, notably lead, to liquid fuels, primarily to suppress preignition and eliminate engine "knock". Recently, the use of these additives (primarily tetraethyl lead) has been largely terminated due to environmental concerns, and alternative formulations have been employed to minimize preignition. However, these metal additives also had the secondary purpose of protecting and enhancing the condition of certain internal components of the engines, notably valve seats; while most newer engines are designed to operate on lead-free fuels, many of the older-type engines will remain in service for many years to come, and these will be subject to potential damage (e.g., valve seat erosion) because leaded fuels will no longer be available. However, it is believed that engine protection can be enhanced, and much of this wear or damage reduced or eliminated, by adding trace amounts of certain metals to the fuel, and it is also believed that suitable amounts may be provided for this without posing environmental concerns, being that it is no longer necessary to include amounts sufficient to suppress preignition. Furthermore, it is believed to be possible for this purpose to use trace amounts of certain metals which do not pose the same threat to the environment as prior materials.

Accordingly, it is an object of the present invention to provide an apparatus for conditioning liquid fuel prior to delivery to an internal combustion engine by adding a trace level of a metallic element or elements to the fuel.

SUMMARY OF THE INVENTION

According to the present invention there is provided a liquid fuel conditioning device or instrument comprising a casing with fuel inlet and outlet ports and at least one insert within the casing which is configured to define at least one passage through which the fuel streams must pass in flowing through the instrument from the inlet to the outlet port, the insert consisting of or containing a trace metal element or more than one trace metal element to be added to the fuel as the fuel flows over the surface of the insert.

In one embodiment the trace metal element is tin and the material of the insert comprises tin to at least 50% and preferably 60%-80% by weight. The insert may include other trace elements such as mercury, lead and/or antimony which it may be desirable to add in trace amounts to the liquid fuel. In a preferred embodiment the insert material consists of an amalgam of all four of these elements. The composition of the amalgam may be such that, by weight, the lead content is low, i.e. under 5%, the mercury content is 5% to 15%, and the antimony content is 10% to 25%, the tin content being 50%-80%.

Preferably, the insert may be configured to define a plurality of passages through which the fuel streams must pass. The insert may be of uniform cross-sectional shape including several fins radiating from a hub portion, whereby spaces defined between the fins form passages for flow of fuel in direct contact with the insert.

The finned shape of the insert ensures a large surface area for contact by the fuel for a given mass of insert material. The number of fins is preferably from 3 to 10, more preferably 4 to 8, and it is desirable for the fins to be spaced uniformly apart around the hub so that equal fuel passages are formed between pairs of adjacent fins. Preferably, the fins are helically curved to direct the fuel along helical flow paths. An insert comprising 6 substantially planar fins has been found to be especially convenient. The insert may be formed as a casting or extruded with helix of 10°-30° per inch.

The casing may comprise a tube fitted with end plugs respectively defining the inlet and outlet ports, the insert or inserts being arranged coaxially inside the tube and having a loose sliding fit therein.

With the inserts formed with fins as described above, the fuel passages between the fins are outwardly confined by the tubular casing so that all the fuel is constrained to pass through the passages in flowing from the inlet port to the outlet port.

If a plurality of inserts be provided they may conveniently be positioned in axial abutment and held axially in position by spring means, such as a coil spring acting between an end plug and the adjacent insert.

The end plugs may comprise nipples or other means for the direct connection of fuel lines, and the plugs may be adapted to receive flow line connectors of different sizes and/or configurations suitable for coupling to the fuel line in which the instrument is connected.

An instrument according to this invention may include within the casing one or more magnets. It is believed that subjecting fuel to a magnetic field prior to delivery to an engine may have beneficial effects on its combustion characteristics. The magnet or magnets may conveniently be located within the casing in longitudinal alignment with the insert or inserts, and preferably downstream side thereof. The effect of the magnetic field is believed to orientate the molecules in the fuel and the precise arrangement of the magnets is not crucial.

DETAILED DESCRIPTION

Figure 1:
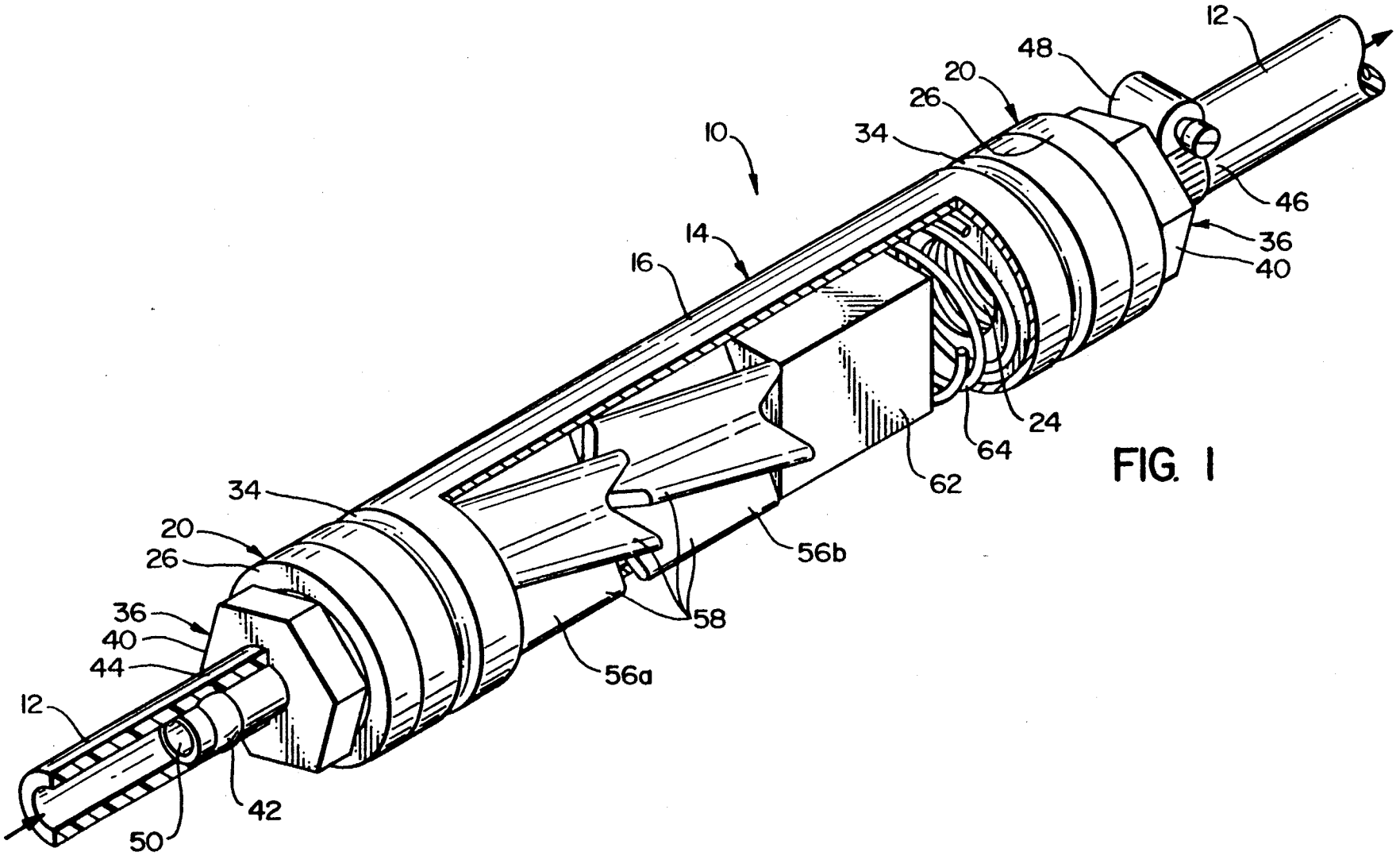
FIG. 1 is a perspective view of an instrument according to the present invention, this being shown partially cut away to reveal the internal inserts and magnet thereof.

The fuel conditioning instrument 10 illustrated in FIG. 1 is intended to be inserted in a fuel line 12 leading to an internal combustion engine, such as a vehicle engine, and for the best effect should be fitted as close as practically convenient to the carburetor or fuel injection pump. The instrument is suitable for four stroke petrol engines, two stroke engines and diesel engines.

Figure 2:
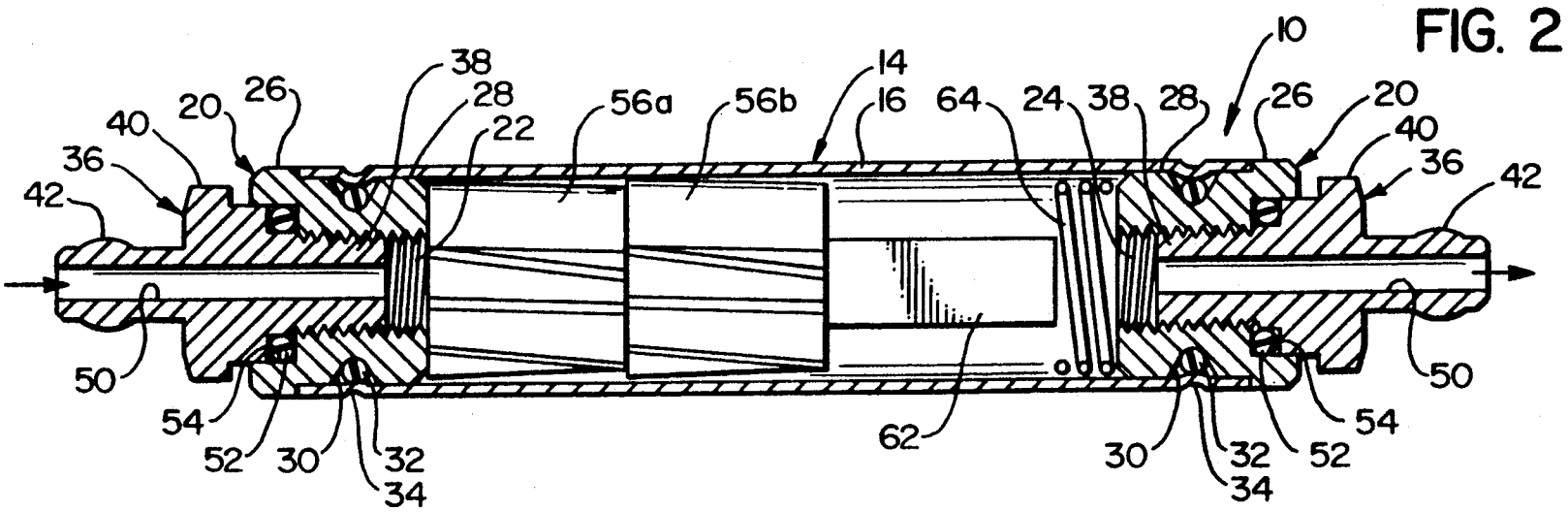
FIG. 2 is an axial longitudinal section through the instrument of FIG. 1.

The instrument shown in FIG. 1 has a casing 14 formed generally by a metal tube 16 of circular cross-section, and two plugs 20 fitted to and within the respective ends of the tube. As can be seen in FIG. 2, the plugs have through bores which define an inlet port 22 and an outlet port 24 of the instrument (see also FIG. 2). Each end plug has an external shoulder 26 arranged to abut the end of the tube, and a portion 28 of each plug which is received with a close fit inside the tube is formed with a groove 30 which accommodates an O-ring seal 32. To fix the end plugs in the tube 16, this is crimped radially inwardly at 34, preferably by cold crimping, at the longitudinal position of the grooves 30; this also assists in ensuring a tight seal between the tube and the end plugs of the casing.

The end plugs 20 are internally screwthreaded for receiving tube connectors or adaptors 36 for coupling the instrument to the fuel line 12, the adaptors 36 being correspondingly externally threaded at their inner ends 38 and having hex heads 40 at their outer ends for engagement by a wrench. As shown, the adaptors are formed with nipples 42 at their outer ends for push fit connection into the ends 44, 46 of a flexible section of the fuel pipe, between which the instrument is to be fitted. This connection is preferably secured by means of hose clamps 48 which fit over the ends 44, 46 of the fuel line. Each nipple is formed with a bore 50 by which the fuel enters/exits the associated port of the instrument, in the direction indicated by the arrows in FIGS. 1 and 2. Different adaptors, e.g. with nipples of various sizes or other forms of pipe union to suit the particular fuel pipe, may be provided and be secured in the end plugs in place of the adaptors shown. O-ring seals 52 seal between the adaptors and the end plugs, and as depicted in the drawings, these seals can be accommodated in counterbores 54 in the end plugs between axially confronting shoulders of the adaptors and plugs.

Housed within the casing is at least one insert 56 of a material comprising one or more than one trace metal element to be added to fuel passed through the instrument. As shown in FIGS. 1 and 2, there are preferably first and second inserts **56*a*, 56*b* positioned in series in the tubular casing immediately adjacent the end plug defining the inlet port 22**. Both inserts may include the same trace element or elements in the same amount by weight, or each element may include a different trace element or elements. Furthermore, in some embodiments there may be only a single insert, or there may be three or more inserts.

Figure 3:
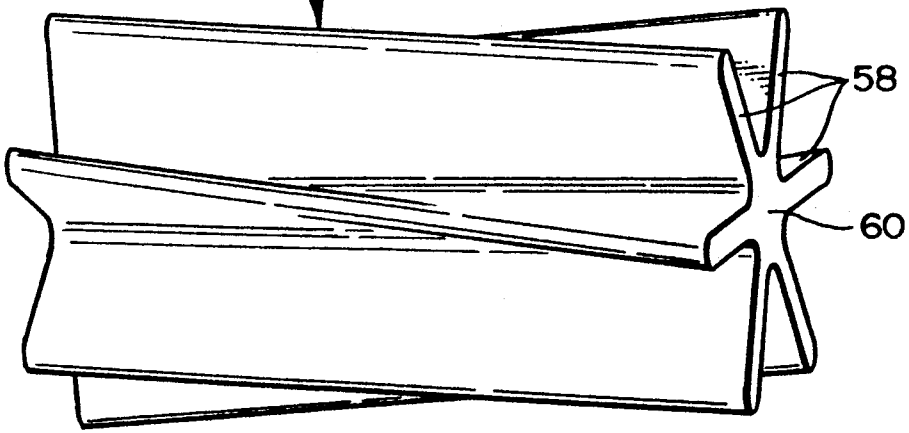
FIG. 3 is a side elevational view of one of the inserts of the device of FIGS. 1-2.
Figure 4:
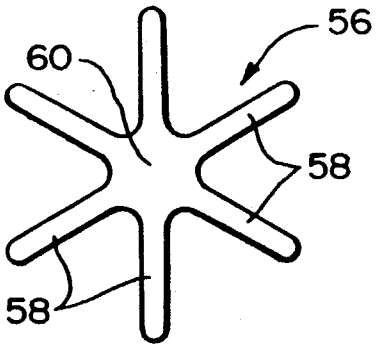
FIG. 4 is an end elevational view on an enlarged scale of the insert of FIG. 3.

As best seen in FIGS. 2-3, each insert is of constant cross-section and comprises a plurality of substantially planar vanes or fins 58 uniformly distributed around and radiating from a central hub portion 60 (see FIG. 4); as shown, an insert having six radial fins has been found to be an eminently suitable arrangement. Each insert is dimensioned to have a sliding fit in the tube 16, and to define, with the surrounding tube, several passages through which fuel streaming through the device is constrained to pass.

Each insert is made of a material comprising a trace metal element to be added to the fuel. The preferred material is an amalgam composed mostly of tin, but including also mercury, antimony and a small amount of lead. However, metallic elements may be added to or deleted from the amalgam as desired for any particular application; for example, although the amounts of lead which are released by the inserts are believed to be so low as to not pose any environmental consequences, it may be desirable under some circumstances to delete this constituent from the amalgam and were to satisfy regulatory or other requirements, and to rely on the remaining constituents (e.g., the tin) for the benefits sought, or to substitute another material for this, such as antimony.

In any event, for the majority of the compositions it has been found preferable to provide tin as a major constituent; for example, in one embodiment, it has been found preferable to form the insert so that this contains at least 50% tin by weight, and preferably 60%-80%. As noted above, the insert may include other trace elements such as mercury, lead and/or antimony which it may be desirable to add in trace amounts to the liquid fuel. Where the insert amalgam is made up of all four of these elements, it has been found eminently suitable to form this with a tin content of about 50%-80%, an antimony content of about 10%-25%, and relatively low mercury and lead contents at 5%-15% and less than 5%, respectively.

Trace amounts of these metallic elements are added to the fuel as this passes over the inserts, and it is believed that this occurs as the materials dissolve or "leach" into the fuel flow. Accordingly, the surface area of the inserts, and therefore the contact of the fuel therewith, is maximized by use of the arrangement of radiating fins which is shown. Also, as is perhaps most clearly shown in FIG. 3, the fins are preferably helically curved so that the fuel is directed along helical paths as it flows through the passages which are defined by these. It is believed that this serves to create turbulence in the fuel flow, thus ensuring a more thorough contact with the transfer surfaces of the inserts, and more efficient transfer of the metallic constituents to the liquid stream. Also, it is believed that the helical paths along which the fuel flow is directed as it exits the inserts will enhance the action of the magnet which is downstream of these, as will be described in the following section. For these purposes, it has been found eminently suitable to form the inserts as a casting or extrusion with a helix of about 240° per foot, i.e., 10°-30° per inch.

Also accommodated in the casing is a magnet 62. As depicted in FIGS. 1 and 2, the magnet is longitudinally aligned with, and on the downstream side of, the inserts 56 so that the fuel is subjected to the influences of the magnetic field after passing through the inserts. It is believed that this enhances the combustion characteristics of the fuel, by imparting a temporary charge on either hydrocarbon constituents of the fuel or possibly impurities suspended therein. An an-isotropic magnet has been found particularly suitable for this purpose. Also, instead of a single magnet, two or more magnets may be provided and be arranged alongside or in series with each other. To hold the inserts and magnet against undesirable axial displacement within the tube 16, a coil spring 64 is included and, as is shown, this is interposed between the magnet and the adjacent end plug defining the outlet port 24.

During its passage through the fuel conditioning instrument the fuel collects trace elements from the inserts 10, and is subjected to the molecule orientation effects of the permanent magnet 64. This conditioning of the fuel enhances its combustion characteristics and improves engine performance and/or aids exhaust emission control by acting something in the manner of a catalyst. The construction of the instrument as described makes it compact and light in weight, which is of importance for road vehicle installation. It is also economical to manufacture, and may be made in various sizes depending on anticipated fuel flow rates, which rates are frequently a function of engine capacity. Modifications are of course possible without departing from the basic inventive concepts. Thus, if thought desirable, for example, at least one of the end plugs may be made detachable to permit replacement of the inserts. Also, the end plugs may be provided with integral flow line connections but this would remove the versatility achieved by having interchangeable adaptors. Still further, other trace metal elements or constituents which may be desirable for conditioning a fuel may be added to or substituted for those in the exemplary embodiments described above.

What is claimed is:

1. A device for conditioning a liquid fuel flowing therethrough, said device comprising:

a casing having a fuel inlet port and a fuel outlet port; and at least one insert within said casing, said insert being configured to define at least one passage through which a stream of said fuel must pass in flowing through said device from said inlet port to said outlet port;

said insert comprising an amalgam containing a plurality of trace metal elements which pass into said fuel as said fuel flows through said passage and over a surface of said insert, said trace elements comprising tin, mercury, and lead.

2. The device of claim 1, wherein said material of said insert comprises at least 50 percent tin by weight.

3. The device of claim 2, wherein said material of said insert comprises about 60 percent to about 80 percent tin by weight.

4. The device of claim 1, wherein said trace elements further comprise antimony.

5. The device of claim 4, wherein said amalgam comprises, by weight, about 50 percent to about 80 percent tin, about 5 percent to about 15 percent mercury, about 5 percent lead, and about 10 percent to about 25 percent antimony.

6. The device of claim 1, wherein said insert is configured to define a plurality of said passages through which streams of said fuel must pass.

7. The device of claim 6, wherein said insert comprises a longitudinally extending hub portion and a plurality of longitudinally extending fin portions radiating from said hub portion so that spaces defined between said fin portions form said passages through which said streams of fuel must pass in contact with said surface of said insert.

8. The device of claim 7, wherein said fin portions are helically curved so that said streams of fuel pass through said passages along helically-curved paths.

9. The device of claim 7, wherein said insert is of substantially uniform cross section so as to enable said insert to be formed by extrusion of said amalgam.

10. The device of claim 7, wherein said casing comprises:

a tube member fitted with end plugs respectively defining said inlet and outlet ports; said insert being disposed coaxially inside said tube and having a loose sliding fit therein.

11. The device of claim 10, wherein said passages formed between said fins are outwardly confined by said tubular member, so that all said fuel is constrained to pass through said passage in flowing from said inlet port to said outlet port.

12. The device of claim 11, further comprising:

a coil mounted in said tube member and acting between one of said end plugs and said insert so that said insert is held axially in position in said tube member.

13. The device of claim 10, wherein said end plugs each further comprise:

a nipple for direct connection to a flexible portion of a fuel line.

14. The device of claim 1, further comprising:

at least one magnet mounted in said casing for subjecting said fuel flowing therethrough to a magnetic field.

15. The device of claim 14, wherein said magnet is a permanent an-isotropic magnet.

16. A device for conditioning a liquid fuel flowing therethrough, said device comprising:

a casing having a fuel inlet port and a fuel outlet port; and at least one insert within said casing, said insert being configured to define at least one passage through which a stream of said fuel must pass in flowing through said device from said inlet port to said outlet port;

said insert comprising a material containing at least one trace metal element to be added to said fuel as said fuel flows through said passage and over a surface of said insert, said material of said insert comprising at least 50 percent tin by weight.

17. The device of claim 16, wherein said material of said insert comprises about 60 percent to about 80 percent tin by weight.

18. The device of claim 16, wherein said material contains a plurality of said trace metal elements to be added to said fuel.

19. The device of claim 18, wherein said material of said insert is an amalgam from which said trace elements pass into said fuel which flows over said surface of said insert.

20. The device of claim 19, wherein said trace elements comprise tin, mercury and lead.

21. The device of claim 19, wherein said trace elements comprise tin, mercury, and antimony.

22. A device for conditioning a liquid fuel flowing therethrough, said device comprising:

a casing having a fuel inlet port and a fuel outlet port;

at least one magnet mounted in said casing for subjecting said fuel flowing therethrough to a magnetic field; and at least one insert mounted in said casing adjacent to and upstream of said magnet, and having a longitudinally extending hub portion and a plurality of longitudinally extending fin portions radiating from said hub portion so that spaces defined between said fin portions form passages through which streams of said fuel must pass in contact with surfaces of said insert as said fuel flows through said device from said inlet port to said outlet port; said insert comprising a material containing at least one trace metal element to be added to said fuel as said fuel flows through said passages and over said surfaces of said insert; and said fin portions of said insert being helically curved so that said streams of fuel pas through said passages along helically-curved paths, and are directed along helically-curved paths as said streams exit said insert and pass through said magnetic field to which said fuel is subjected by said magnet.

23. The device of claim 22, wherein said fin portions of said insert have a helical curvature of about 10 degrees to about 30 degrees per inch.

24. The device of claim 22 wherein said material of said insert comprises at least 50 percent tin by weight.

* * * * *